US010459371B2

(12) United States Patent
Shiraki

(10) Patent No.: US 10,459,371 B2
(45) Date of Patent: Oct. 29, 2019

(54) IMAGE FORMING APPARATUS INCLUDING DRUM CARTRIDGE

(71) Applicant: Brother Kogyo Kabushiki Kaisha, Nagoya-shi, Aichi-ken (JP)

(72) Inventor: Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/039,418

(22) Filed: Jul. 19, 2018

(65) Prior Publication Data

US 2019/0025731 A1 Jan. 24, 2019

(30) Foreign Application Priority Data

Jul. 20, 2017 (JP) ..... 2017-140952

(51) Int. Cl.
*G03G 15/08* (2006.01)
*G03G 21/16* (2006.01)
*G03G 21/18* (2006.01)

(52) U.S. Cl.
CPC ..... *G03G 15/0886* (2013.01); *G03G 15/0896* (2013.01); *G03G 21/1633* (2013.01); *G03G 21/1853* (2013.01)

(58) Field of Classification Search
CPC ..... G03G 15/0896; G03G 21/1642; G03G 21/1647; G03G 2221/1892; G03G 21/1661; G03G 21/1671; G03G 21/1676
USPC ..... 16/80, 71, 250, 251
See application file for complete search history.

(56) References Cited

U.S. PATENT DOCUMENTS 5,508,785 A * 4/1996 Takahashi ..... G03G 15/0896 399/111
7,174,116 B2 2/2007 Ikebata
7,486,908 B2 2/2009 Ikebata
2006/0233566 A1 10/2006 Ikebata
2007/0110472 A1 5/2007 Ikebata
2017/0075292 A1 3/2017 Nagae et al.

FOREIGN PATENT DOCUMENTS

JP 2006-301194 A 11/2006
JP 2017-058517 A 3/2017

* cited by examiner

*Primary Examiner* — Clayton E. LaBalle
*Assistant Examiner* — Arlene Heredia
(74) *Attorney, Agent, or Firm* — Banner & Witcoff, Ltd.

(57) ABSTRACT

There is provided an image forming apparatus including a body, a drum cartridge and a developing cartridge both of which are installable into the body, and a shutter attached to the body. The shutter is movable between a first position to prevent installation of the developing cartridge while allowing installation of the drum cartridge with the drum cartridge and the developing cartridge being removed from the body, and a second position to allow installation of the developing cartridge with the drum cartridge being installed in the body.

14 Claims, 11 Drawing Sheets

IMAGE FORMING APPARATUS INCLUDING DRUM CARTRIDGE

CROSS REFERENCE TO RELATED APPLICATION

The present application claims priority from Japanese Patent Application No. 2017-140952, filed on Jul. 20, 2017, the disclosure of which is incorporated herein by reference in its entirety.

BACKGROUND

Field of the Invention

The present disclosure relates to image forming apparatuses having a drum cartridge.

Description of the Related Art

Conventionally, there are known image forming apparatuses including a main body, a drum cartridge installable into the main body, and a developing cartridge installable into the main body independently from the drum cartridge.

SUMMARY

In the image forming apparatus publicly known, when the drum cartridge and the developing cartridge are removed from the main body, a user may not readily realize whether the drum cartridge or the developing cartridge should be first installed into the main body.

Therefore, the user is more liable to make mistakes on installing the drum cartridge and the developing cartridge into the main body.

Hence, an object of the present disclosure is to provide an image forming apparatus capable of preventing the mistakes on installing the drum cartridge and the developing cartridge into the main body.

According to an aspect of the present disclosure, there is provided an image forming apparatus including: a body; a drum cartridge installable into the body; a developing cartridge installable into the body; and a shutter attached to the body. The shutter is movable between a first position to prevent installation of the developing cartridge but to allow installation of the drum cartridge with the drum cartridge and the developing cartridge being removed from the body, and a second position to allow installation of the developing cartridge with the drum cartridge being installed in the body.

According to such a configuration, with the drum cartridge and the developing cartridge being removed from the body, the shutter locates at the first position to prevent installation of the developing cartridge but to allow installation of the drum cartridge.

By virtue of this, a user can first notice that the drum cartridge is to be installed into the body.

Thereafter, if the user has installed the drum cartridge into the body, then the shutter locates at the second position. By virtue of this, installation of the developing cartridge is allowed.

By virtue of this, after the drum cartridge is installed in the body, the user can notice that the developing cartridge is to be installed into the body.

As a result, it is possible to prevent mistakes on installing the drum cartridge and the developing cartridge into the body.

DESCRIPTION OF THE EMBODIMENTS

An outline of an image forming apparatus 1 will be explained below.

Figure 1:
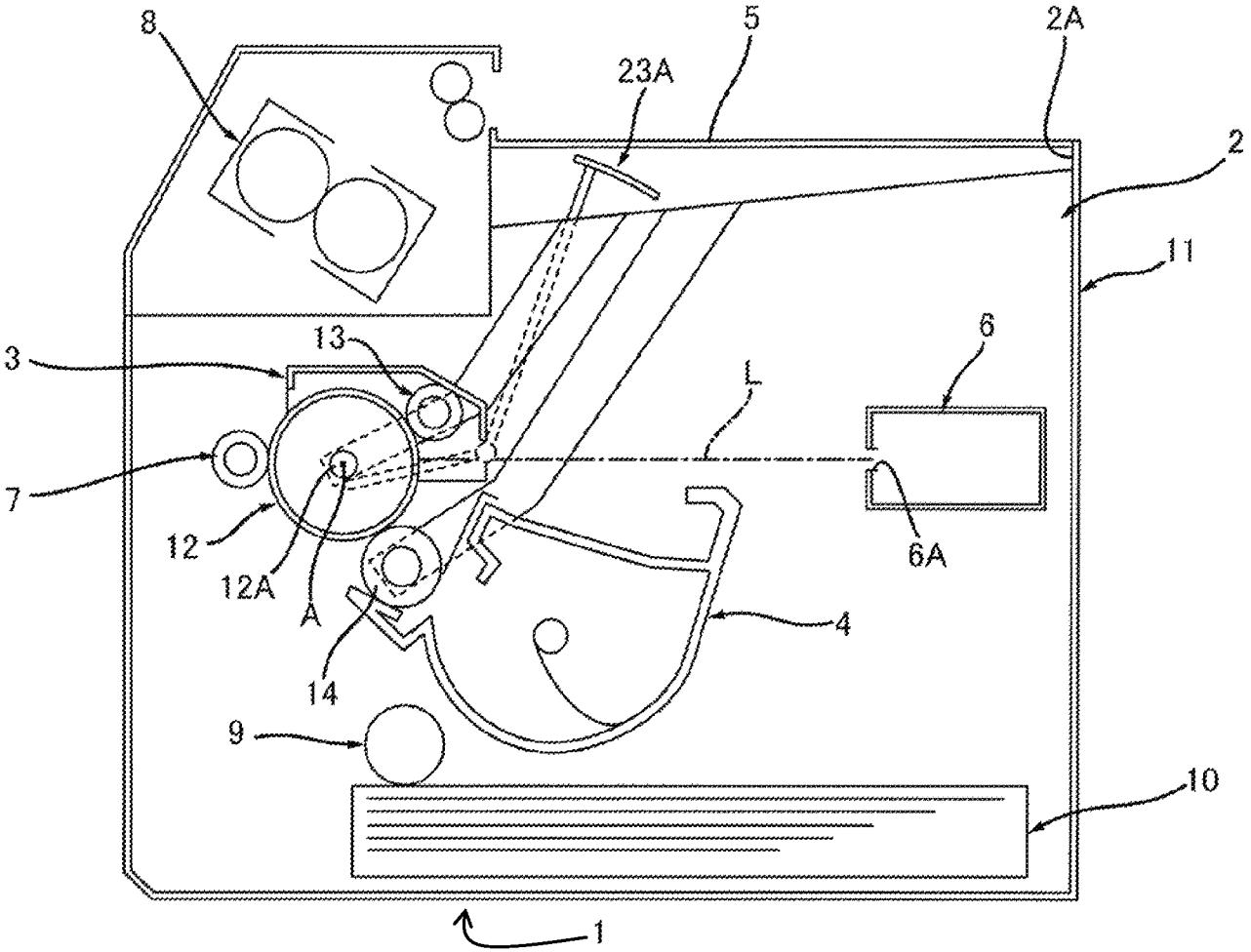
FIG. 1 is a schematic configuration diagram of an image forming apparatus.

As depicted in FIG. 1, the image forming apparatus 1 includes a (main) body 2, a drum cartridge 3, and a developing cartridge 4.

The body 2 has an opening 2A for installing the drum cartridge 3 and the developing cartridge 4 into the body 2. The opening 2A is used commonly in installing the drum cartridge 3 into the body 2, and in installing the developing cartridge 4 into the body 2. The body 2 includes a casing 11, a cover 5, a laser scanning unit 6, a transfer roller 7, a fixation device 8, a paper feed unit 9, and a paper feed tray 10.

The casing 11 constitutes the exterior of the body 2. The casing 11 accommodates the laser scanning unit 6, the transfer roller 7, the fixation device 8, the paper feed unit 9, and the paper feed tray 10. Further, with the drum cartridge 3 and the developing cartridge 4 being installed in the body 2, the casing 11 accommodates the drum cartridge 3 and the developing cartridge 4. The casing 11 has a box-like shape.

The cover 5 is movable between an opened position (see FIG. 2) to uncover the opening 2A and a closed position (see FIG. 1) to cover the opening 2A. The cover 5 is a top cover positioned at the upper end of the body 2. The cover 5 at the closed position locates above the laser scanning unit 6.

The laser scanning unit 6 is provided to expose the surface of an aftermentioned photoconductive drum 12. The laser scanning unit 6 has an emission port 6A for emitting light L. The light L emitted from the emission port 6A falls on the surface of the photoconductive drum 12 after passing below an aftermentioned charging roller 13 and above the developing cartridge 4.

The transfer roller 7 is provided to transfer toner image formed on the surface of the photoconductive drum 12 to printing paper. The transfer roller 7 is in contact with the surface of the photoconductive drum 12 with the drum cartridge 3 being installed in the body 2.

The fixation device 8 is provided to fix the toner image on the printing paper by way of heating and pressurizing the printing paper with the transferred toner image. The printing paper having passed through the fixation device 8 is discharged onto the cover 5.

The paper feed unit 9 is provided to supply the printing paper in the paper feed tray 10 to somewhere between the photoconductive drum 12 and the transfer roller 7.

The paper feed tray 10 is provided to accommodate the printing paper.

The drum cartridge 3 is installable into the body 2 through the opening 2A. The drum cartridge 3 includes the photoconductive drum 12 and the charging roller 13.

The photoconductive drum 12 is rotatable about a rotation axis A extending in an axial direction. The photoconductive drum 12 includes a drum shaft 12A extending along the rotation axis A.

The charging roller 13 is provided to electrically charge the surface of the photoconductive drum 12. The charging roller 13 is in contact with the surface of the photoconductive drum 12.

The developing cartridge 4 is installable into the body 2 through the opening 2A. The developing cartridge 4 is installable into the body 2 independently from the drum cartridge 3. The developing cartridge 4 accommodates toner. The developing cartridge 4 includes a developing roller 14.

The developing roller 14 is provided to supply the toner to the photoconductive drum 12. The developing roller 14 is positioned below the drum shaft 12A with the drum cartridge 3 and the developing cartridge 4 being installed in the body 2. In other words, with the drum cartridge 3 and the developing cartridge 4 being installed in the body 2 and with the cover 5 at the closed position, the distance between the cover 5 and the developing roller 14 along an up/down direction is longer than the distance between the cover 5 and the drum shaft 12A along the up/down direction. With the drum cartridge 3 and the developing cartridge 4 being installed in the body 2, the developing roller 14 is in contact with the surface of the photoconductive drum 12.

Next, details of the body 2 will be explained.

Figure 2:
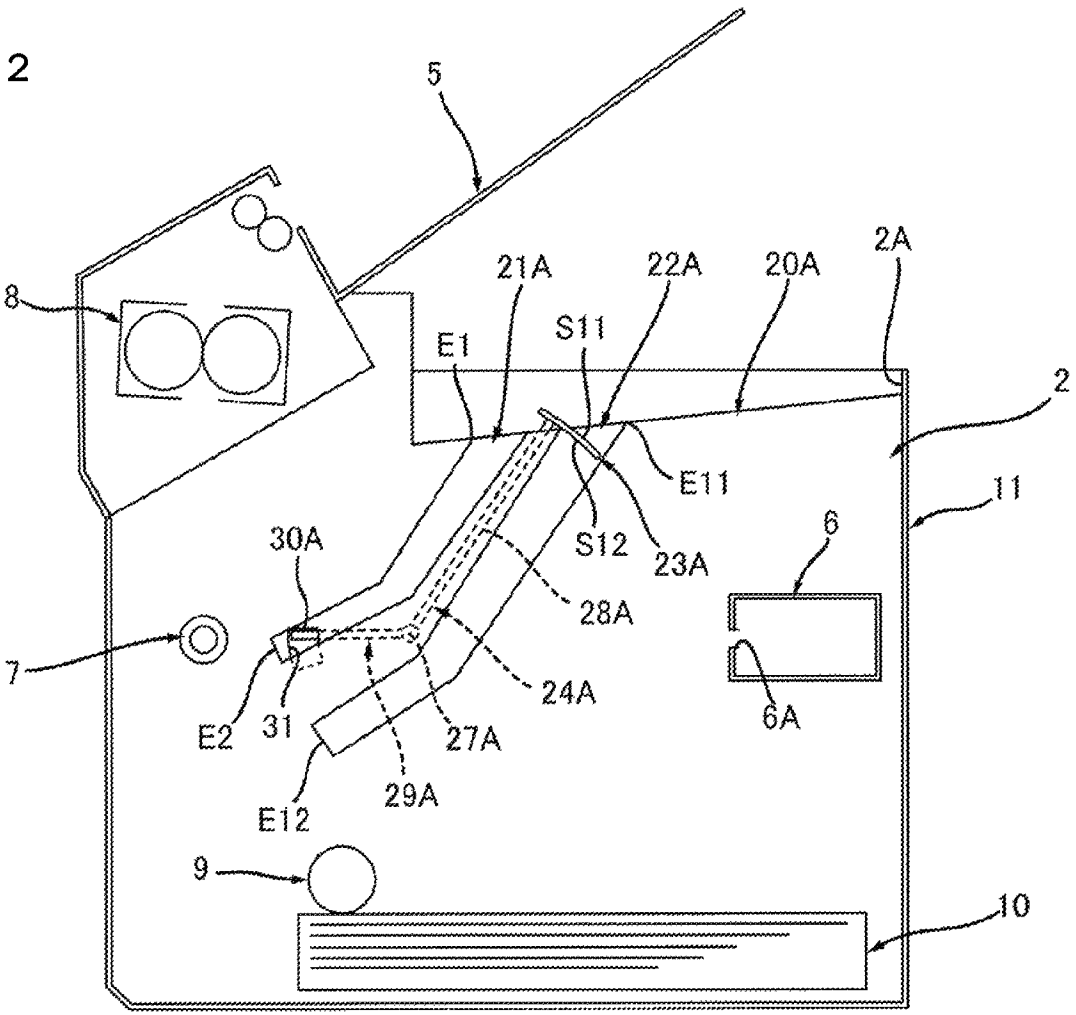
FIG. 2 is an explanatory diagram for explaining the (main) body and the shutter depicted in FIG. 1, showing a state where a drum cartridge and a developing cartridge are removed from the body.
Figure 3:
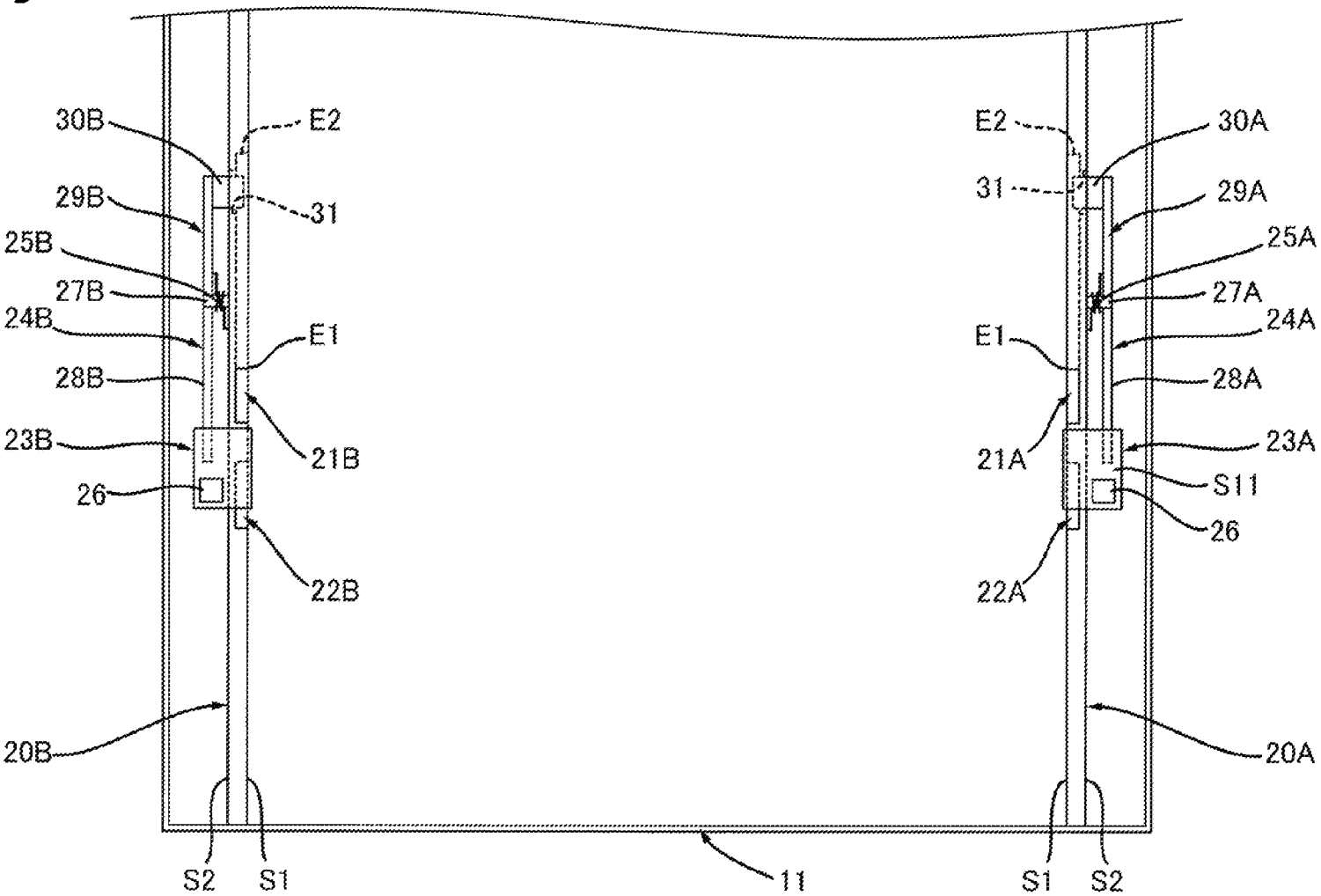
FIG. 3 is a plan view of the body depicted in FIG. 2.

As depicted in FIGS. 2 and 3, the body 2 includes a side frame 20A, a side frame 20B (see FIG. 3), a drum guide 21A, a drum guide 21B (see FIG. 3), a developing guide 22A, and a developing guide 22B (see FIG. 3).

The side frame 20A is positioned in the casing 11. The side frame 20A extends in the up/down direction. The side frame 20A has an inner surface S1 and an outer surface S2 along the axial direction. With the drum cartridge 3 being installed in the body 2 (see FIG. 5), the outer surface S2 is positioned farther away from the drum cartridge 3 than the inner surface S1 along the axial direction.

With the drum cartridge 3 being installed in the body 2 (see FIG. 5), as depicted in FIG. 3, the side frame 20B is positioned at the opposite side from the side frame 20A with respect to the drum cartridge 3 along the axial direction. The side frame 20A is positioned in the casing 11. As with the side frame 20A, the side frame 20B has an inner surface S1 and an outer surface S2 extending in the up/down direction.

When the drum cartridge 3 is installed into the body 2, the drum guide 21A guides the drum cartridge 3. The drum guide 21A is positioned on the inner surface S1 of the side frame 20A. As depicted in FIG. 2, the drum guide 21A extends in a drum installation direction. The drum installation direction is the direction along which the drum cartridge 3 moves when the drum cartridge 3 is installed into the body 2. The drum guide 21A has an upstream end E1 and a downstream end E2 along the drum installation direction. The upstream end E1 is positioned between the cover 5 and the downstream end E2 along the drum installation direction, with the cover 5 at the closed position. The downstream end E2 is positioned between the transfer roller 7 and the laser scanning unit 6 along the horizontal direction along a horizontal direction.

When the drum cartridge 3 is installed into the body 2 (see FIG. 5), the drum guide 21B depicted in FIG. 3 guides the drum cartridge 3 together with the drum guide 21A. With the drum cartridge 3 being installed in the body (see FIG. 5), the side frame 21B is positioned at the opposite side from the side frame 21A with respect to the drum cartridge 3 along the axial direction. In particular, the drum guide 21B is positioned on the inner surface S1 of the side frame 20B. The drum guide 21B extends in the same direction as the drum guide 21A. Further, the drum guide 21B has the same shape as the drum guide 21A.

The developing guide 22A guides the developing cartridge 4 when the developing cartridge 4 (see FIG. 1) is installed into the body 2. The developing guide 22A is positioned on the inner surface S1 of the side frame 20A. As depicted in FIG. 2, the developing guide 22A is positioned between the drum guide 21A and the laser scanning unit 6. The developing guide 22A extends in a developing cartridge installation direction. The developing cartridge installation direction is the direction along which the developing cartridge 4 moves when the developing cartridge 4 is installed into the body 2. The developing guide 22A is longer than the drum guide 21A. The developing guide 22A has an upstream end E11 and a downstream end E12 along the developing cartridge installation direction. The upstream end E11 is positioned between the cover 5 and the downstream end E12 along the developing cartridge installation direction, with the cover 5 being positioned at the closed position. The downstream end E12 is positioned below the downstream end E2 of the drum guide 21A.

The developing guide 22B depicted in FIG. 3 guides the developing cartridge 4 together with the developing guide 22A when the developing cartridge 4 (see FIG. 1) is installed into the body 2. With the developing cartridge 4 being installed in the body 2, the developing guide 22B is positioned on the opposite side from the developing guide 22A with respect to the developing cartridge 4 along the axial direction. In particular, the developing guide 22B is positioned on the inner surface of the side frame 20B. The developing guide 22B extends in the same direction as the developing guide 22A. Further, the developing guide 22B has the same shape as the developing guide 22A.

As depicted in FIGS. 2 and 3, the image forming apparatus 1 further includes a shutter 23A, a shutter 23B (see FIG. 3), an arm 24A, an arm 24B (see FIG. 3), a pressing member 25A (see FIG. 3), and a pressing member 25B (see FIG. 3).

With the drum cartridge 3 and the developing cartridge 4 being removed from the body 2, the shutter 23A can prevent the developing cartridge 4 from being installed but permits or allows installation of the drum cartridge 3. That is, the shutter 23A cannot prevent the drum cartridge 3 from being installed. On this occasion, the shutter 23A locates at the first position. In detail, at the first position, the shutter 23A shutters the developing guide 22A as viewed from a developing cartridge installation direction. With that, the shutter 23A at the first position can prevent the installation of the developing cartridge 4. Further, at the first position, the shutter 23A unshutters the drum guide 21A as viewed from the drum installation direction. With that, the shutter 23A at the first position permits installation of the drum cartridge 3.

Figure 4:
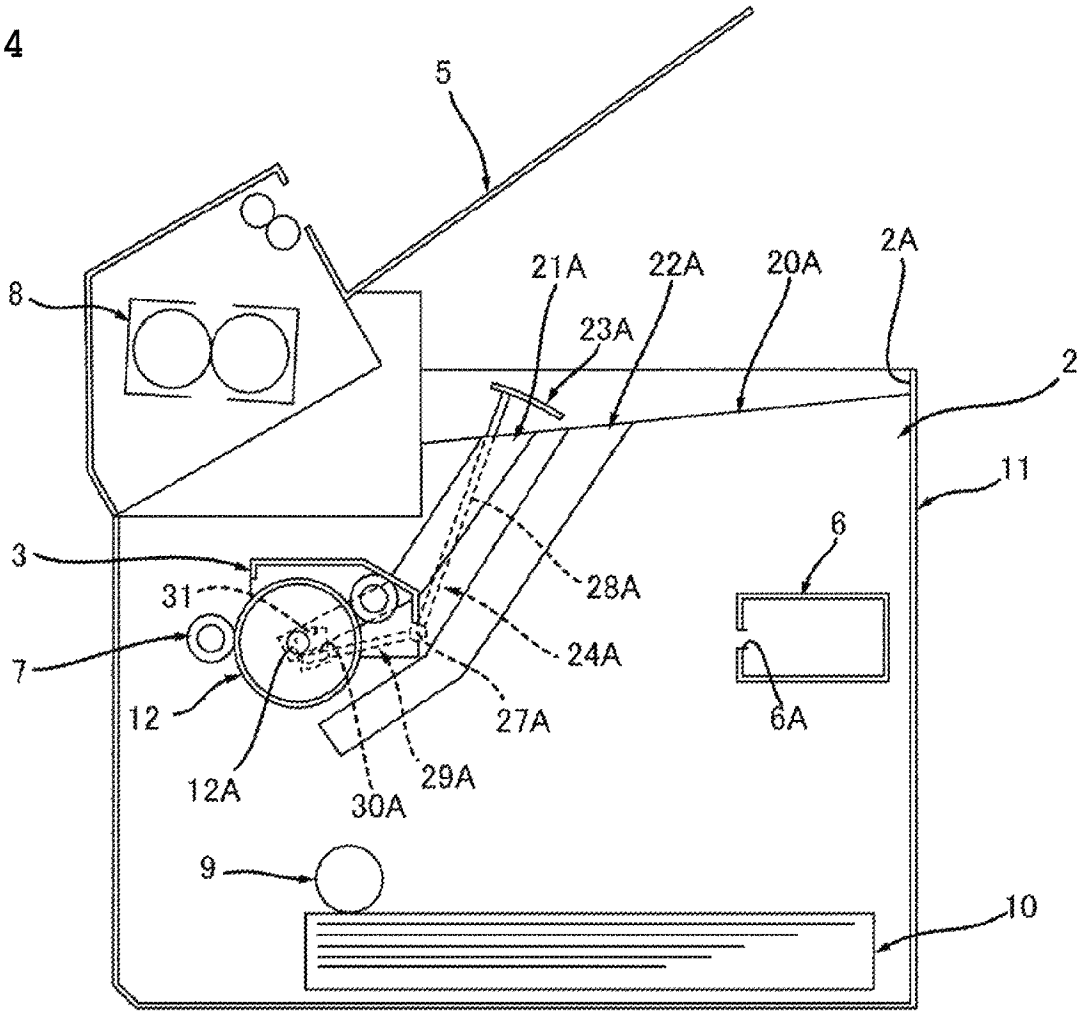
FIG. 4 is an explanatory diagram for explaining a movement of the shutter depicted in FIG. 2, showing a state where the drum cartridge is installed in the body.
Figure 5:
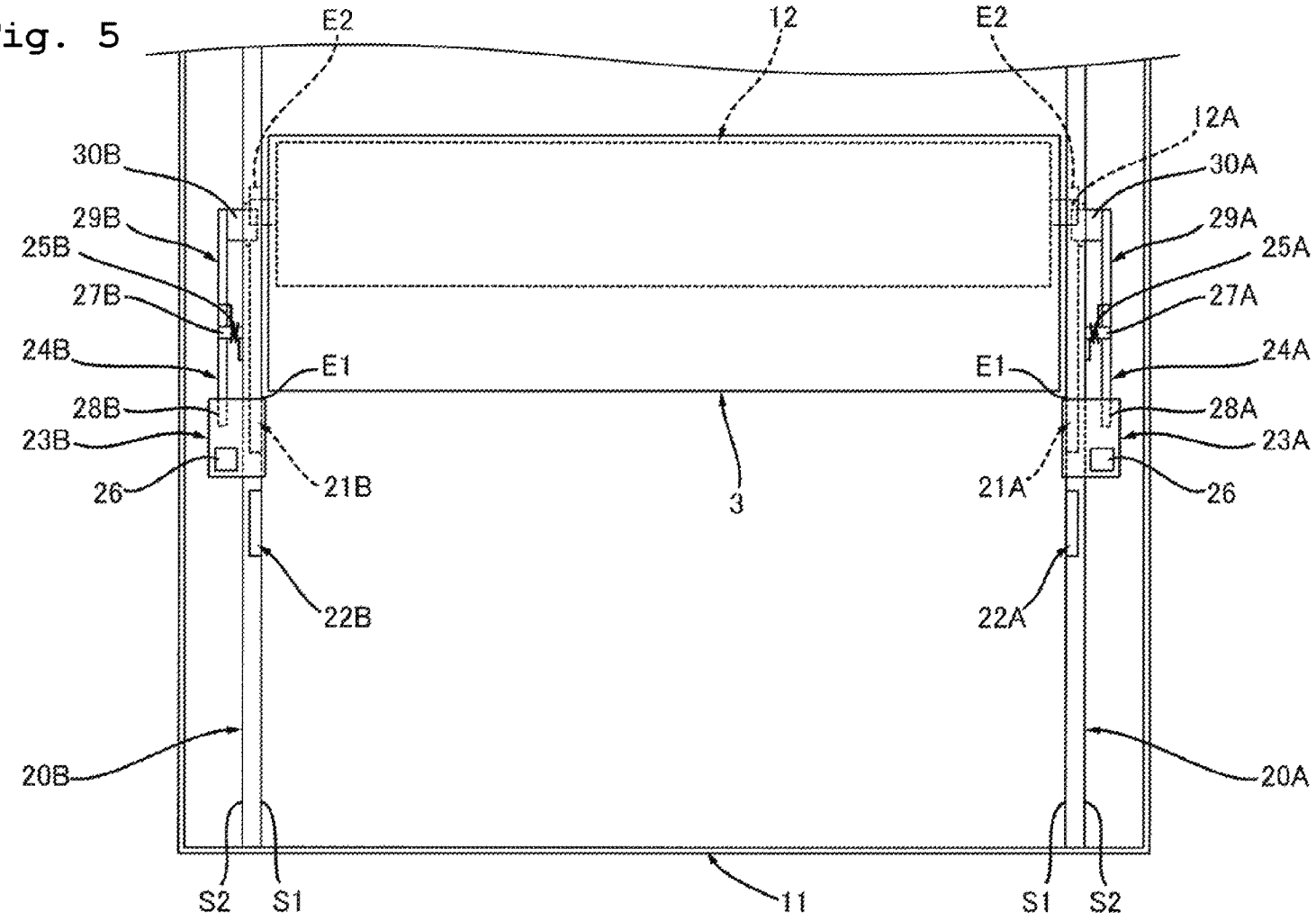
FIG. 5 is a plan view of the body depicted in FIG. 4.

Further, as depicted in FIGS. 4 and 5, with the drum cartridge 3 being installed in the body 2, the shutter 23A allows installation of the developing cartridge 4. On this occasion, the shutter 23A locates at the second position. That is, the shutter 23A is movable between the first position and the second position. In detail, at the second position, the shutter 23A unshutters the developing guide 22A as viewed from the developing cartridge installation direction. With that, the shutter 23A at the second position allows installation of the developing cartridge 4. Further, at the second position, the shutter 23A shutters the drum guide 21A as viewed from the drum installation direction. Note that at the second position, the shutter 23A may not shutter the drum guide 21A as viewed from the drum installation direction.

As depicted in FIG. 3, the body 2 is provided with the shutter 23A via the arm 24A. In detail, the shutter 23A is attached to the side frame 20A via the arm 24A. The shutter 23A at the first position extends in a direction intersecting the developing cartridge installation direction. The shutter 23A has a plate-like shape. The shutter 23A has a display portion 26.

The display portion 26 displays guidance information. The display portion 26 is part of the shutter 23A. In detail, as depicted in FIG. 2, the shutter 23A has a surface S11 and a surface S12. With the shutter 23A at the first position, the surface S12 is positioned between the downstream end E12 of the developing guide 22A and the surface S11 along the developing cartridge installation direction. As depicted in FIG. 3, the display portion 26 is part of the surface S11 of the shutter 23A. As an example of the guidance, the display portion 26 displays the word "closed". By virtue of this, With the shutter 23A at the first position, the user can know that the developing guide 22A is closed or shut. Further, as depicted in FIG. 5, with the shutter 23A at the second position, the user can know that the drum guide 21A is closed.

As depicted in FIG. 3, in the same manner as the shutter 23A, with the drum cartridge 3 and the developing cartridge 4 being removed from the body 2, the shutter 23B can prevent installation of the developing cartridge 4 but allows installation of the drum cartridge 3. On this occasion, the shutter 23B locates at a third position. In detail, at the third position, the shutter 23B shutters the developing guide 22B as viewed from the developing cartridge installation direction. With that, together with the shutter 23A at the first position, the shutter 23B at the third position can prevent installation of the developing cartridge 4. Further, at the third position, the shutter 23B unshutters the drum guide 21B as viewed from the drum installation direction. With that, the shutter 23B at the third position allows installation of the drum cartridge 3.

Further, as depicted in FIG. 5, with the drum cartridge 3 being installed in the body 2, the shutter 23B allows installation of the developing cartridge 4. On this occasion, the shutter 23B locates at a fourth position. That is, the shutter 23B is movable between the third position and the fourth position. In detail, at the fourth position, the shutter 23B unshutters the developing guide 22B as viewed from the developing cartridge installation direction. With that, the shutter 23B at the fourth position permits installation of the developing cartridge 4. Further, at the fourth position, the shutter 23B shutters the drum guide 21B as viewed from the drum installation direction.

The shutter 23B has practically the same shape as the shutter 23A. The body 2 is provided with the shutter 23B via the arm 24B.

As depicted in FIG. 3, the arm 24A supports the shutter 23A. The arm 24A is attached to the body 2. In detail, along the axial direction, the arm 24A is positioned outside of the drum guide 21A and the developing guide 22A. The arm 24A is attached to the outer surface S2 of the side frame 20A along the axial direction. The arm 24A is revolvable about the body 2. By virtue of this, the shutter 23A can revolve between the first position and the second position. In detail, the arm 24A has a revolving shaft 27A, a rod 28A, and a rod 29A.

The revolving shaft 27A is revolvably attached to the side frame 20A. By virtue of this, the arm 24A is connected to the body 2. The revolving shaft 27A extends in the axial direction. The revolving shaft 27A has a cylindrical shape. As depicted in FIG. 2, the revolving shaft 27A does not overlap with the drum guide 21A as viewed along the axial direction. The revolving shaft 27A is positioned between the drum guide 21A and the developing guide 22A.

As depicted in FIGS. 2 and 3, the rod 28A connects the shutter 23A and the revolving shaft 27A. The rod 28A is positioned between the shutter 23A and the revolving shaft 27A. The rod 28A extends in the radial direction of the revolving shaft 27A. One end of the rod 28A is connected to the shutter 23A. That is, the arm 24A is connected to the shutter 23A. The other end of the rod 28A is connected to the revolving shaft 27A.

The rod 29A extends from the revolving shaft 27A. In detail, with the drum cartridge 3 being removed from the body 2, the rod 29A extends from the revolving shaft 27A toward the downstream end E2 of the drum guide 21A.

The rod 29A has a contact surface 30A. With the drum cartridge 3 being removed from the body 2, the contact surface 30A is positioned on the inside of the downstream end E2 of the drum guide 21A via the opening 31 of the side frame 20A. With the drum cartridge 3 being removed from the body 2, the contact surface 30A intersects the drum installation direction. The contact surface 30A is a flat surface. As depicted in FIG. 5, with the drum cartridge 3 being installed in the body 2, the contact surface 30A is in contact with the drum cartridge 3. In detail, with the drum cartridge 3 being installed in the body 2, the contact surface 30A is in contact with part of the drum cartridge 3. In particular, with the drum cartridge 3 being installed in the body 2, the contact surface 30A is in contact with the drum shaft 12A. With the drum shaft 12A in contact with the contact surface 30A, in resistance against the pressing force of the pressing member 25A, the arm 24A revolves toward the direction in which the shutter 23A moves from the first position to the second position. By virtue of this, with the drum cartridge 3 being installed in the body 2, the shutter 23A locates at the second position.

As depicted in FIG. 3, the arm 24B supports the shutter 23B. Along the axial direction, the arm 24B is positioned outside of the drum guide 21B and the developing guide 22B. The arm 24B is attached to the outer surface S2 of the side frame 20B along the axial direction. The arm 24B has practically the same shape as the arm 24A. That is, the arm 24B has a revolving shaft 27B, a rod 28B, and a rod 29B. The revolving shaft 27B has practically the same shape as the revolving shaft 27A. The rod 28B has practically the same shape as the rod 28A. The rod 29B has practically the same shape as the rod 29A. The rod 29B has a contact surface 30B. The contact surface 30B has practically the same shape as the contact surface 30A. Explanations for the revolving shaft 27B, the rod 28B, the rod 29B and the contact surface 30B will be omitted because they would be the same as for the revolving shaft 27A, the rod 28A, the rod 29A and the contact surface 30A. When the drum cartridge 3 is installed into the body 2, the drum shaft 12A comes to contact with the contact surface 30B of the arm 24B such that in resistance against the pressing force of the pressing member 25B, the arm 24B revolves toward the direction in which the shutter 23B moves from the third position to the fourth position. By virtue of this, with the drum cartridge 3 being installed in the body 2, the shutter 23B locates at the fourth position.

As depicted in FIG. 5, with the shutter 23A at the second position, the pressing member 25A presses the arm 24A toward such a direction as for the shutter 23A to head to the first position. By virtue of this, with the drum cartridge 3 being removed from the body 2, due to the pressing force of the pressing member 25A, the arm 24A revolves in the direction for the shutter 23A to head to the first position while the shutter 23A is moving from the second position to the first position. In particular, the pressing member 25A is a torsion spring. One end of the pressing member 25A is in contact with the side frame 20A. The other end of the pressing member 25A is in contact with the arm 24A.

With the shutter 23B at the fourth position, the pressing member 25B presses the arm 24B toward such a direction as for the shutter 23B to head to the third position. By virtue of this, with the drum cartridge 3 being removed from the body 2, due to the pressing force of the pressing member 25B, the arm 24B revolves in the direction for the shutter 23B to head to the third position while the shutter 23B is moving from the fourth position to the third position. In particular, the pressing member 25B is a torsion spring. One end of the pressing member 25B is in contact with the side frame 20B. The other end of the pressing member 25B is in contact with the arm 24B.

Functions and Effects

According to the image forming apparatus 1, as depicted in FIGS. 2 and 3, with the drum cartridge 3 and the developing cartridge 4 being removed from the body 2, the shutter 23A locates at the first position and can prevent installation of the developing cartridge 4 but allows installation of the drum cartridge 3.

By virtue of this, the user can first notice that the drum cartridge 3 is to be installed into the body 2.

Then, as depicted in FIGS. 4 and 5, if the user has installed the drum cartridge 3 into the body 2, then the shutter 23A locates at the second position to allow installation of the developing cartridge 4.

By virtue of this, after the drum cartridge 3 is installed in the body 2, the user can notice that the developing cartridge 4 is to be installed into the body 2.

As a result, it is possible to prevent mistakes on installing the drum cartridge 3 and the developing cartridge 4 into the body 2.

Second Embodiment

Figure 6:
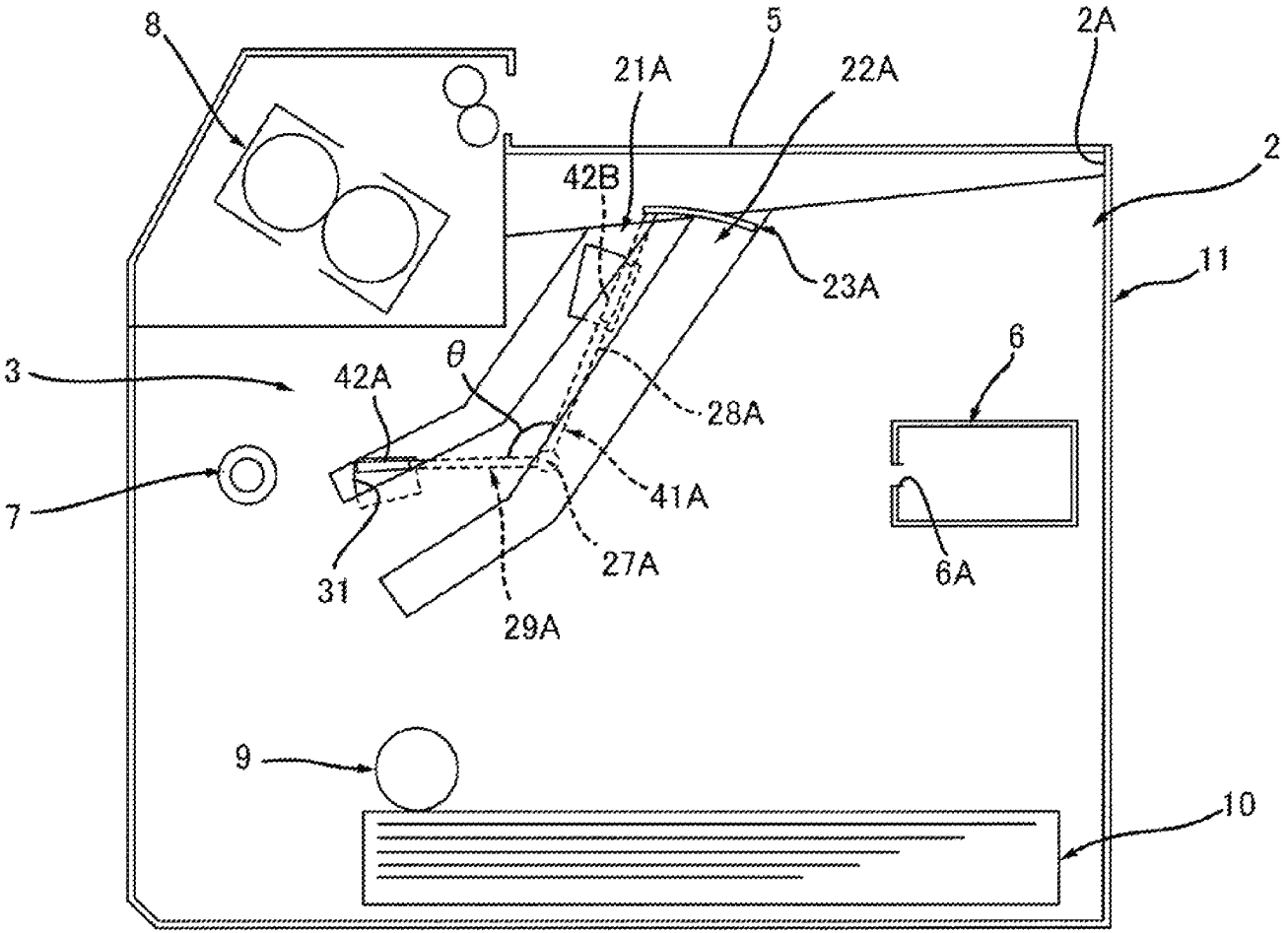
FIG. 6 is an explanatory diagram for explaining a second embodiment, showing a state where the drum cartridge and the developing cartridge are removed from the body.
Figure 7:
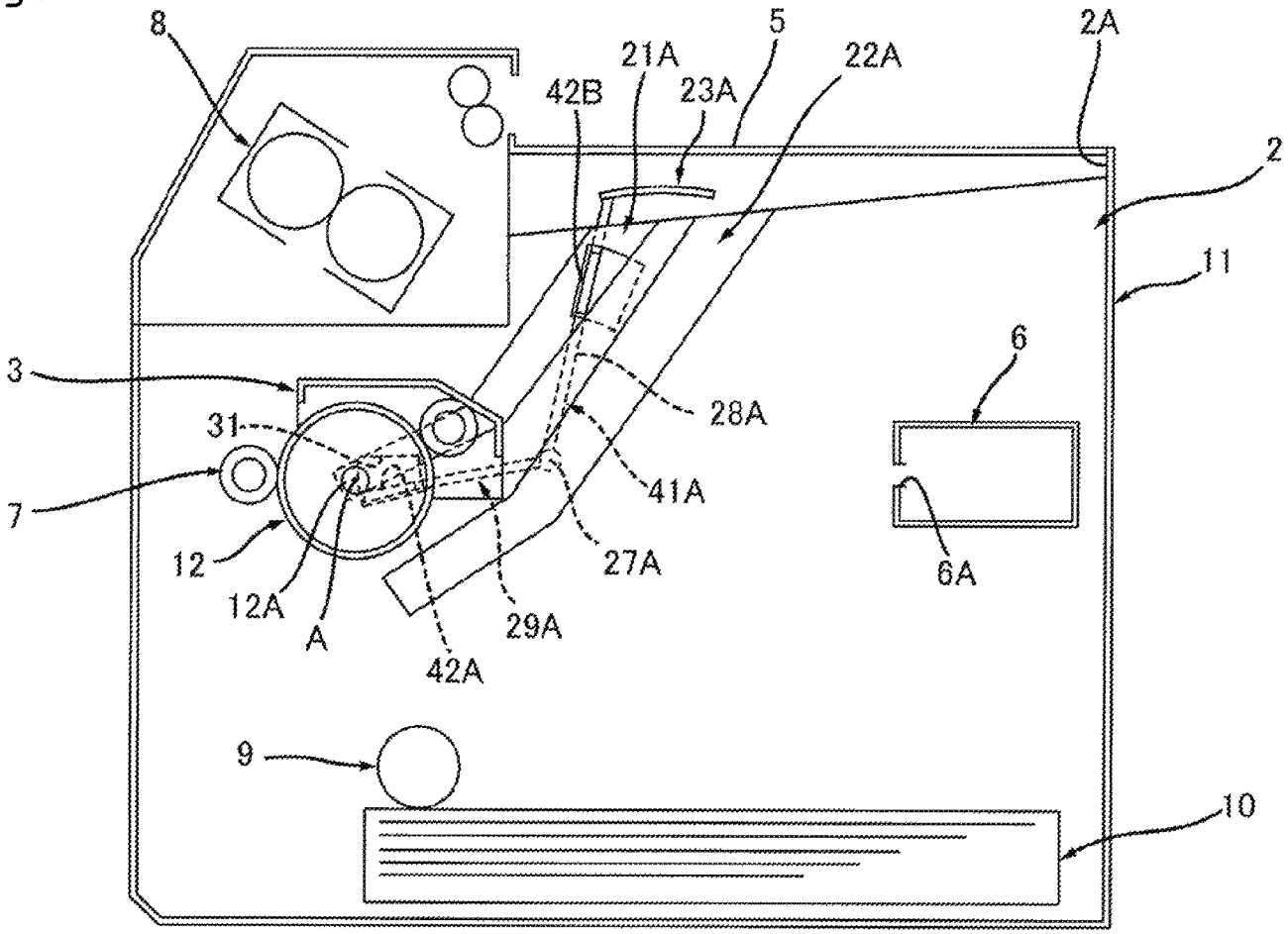
FIG. 7 is an explanatory diagram for explaining the second embodiment together with FIG. 6, showing a state where the drum cartridge is installed in the body.

Next, referring to FIGS. 6 and 7, a second embodiment will be explained. In the second embodiment, the same numerals or alpha-numerals are assigned to the same members as those in the first embodiment, and any explanation therefor will be omitted.

In the second embodiment, an arm 41A has a contact surface 42A and a contact surface 42B.

As with the contact surface 30A in the first embodiment, with the drum cartridge 3 being installed in the body 2, the contact surface 42A is in contact with the drum cartridge 3.

With the drum cartridge 3 being removed from the body 2, the contact surface 42B is in contact with the drum cartridge 3. In detail, with the drum cartridge 3 being removed from the body 2, the contact surface 42B is in contact with the drum shaft 12A. With the drum shaft 12A in contact with the contact surface 42B, the arm 41A revolves toward the direction in which the shutter 23A moves from the first position to the second position. By virtue of this, with the drum cartridge 3 being removed from the body 2, it is possible to smoothly move the shutter 23A from the first position to the second position. The contact surface 42B is part of the rod 28A. With the drum cartridge 3 being removed from the body 2, the contact surface 42B is positioned on the inside of the drum guide 21A via the opening 43 of the side frame 20A. With the drum cartridge 3 being removed from the body 2, the contact surface 42B intersects the direction along which the drum cartridge 3 is removed from the body. The contact surface 42B is a flat surface. The angle θ formed between the contact surface 42A and the contact surface 42B is not smaller than 90° and not larger than 170°.

Further, according to the second embodiment, being not depicted, though, the arm attached to the side frame 20B has the same shape as the arm 41A.

According to the second embodiment, it is also possible to obtain the same functions and effects as the first embodiment.

Third Embodiment

Next, referring to FIGS. 8 to 11, a third embodiment will be explained. In the third embodiment, the same numerals or alpha-numerals are assigned to the same members as those in the first and second embodiments, and any explanation therefor will be omitted.

Figure 8:
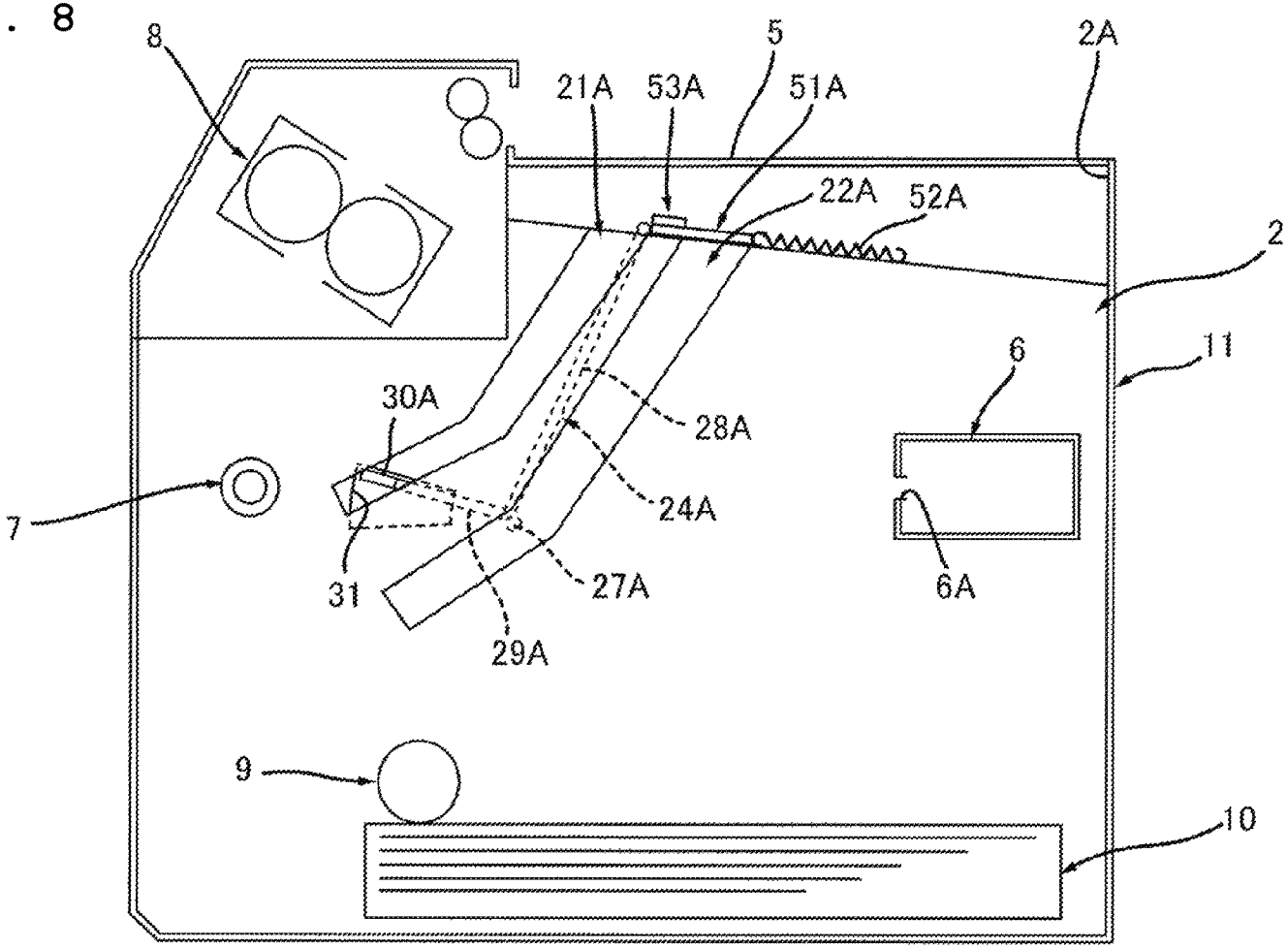
FIG. 8 is an explanatory diagram for explaining a third embodiment, showing a state where the drum cartridge and the developing cartridge are removed from the body.
Figure 9:
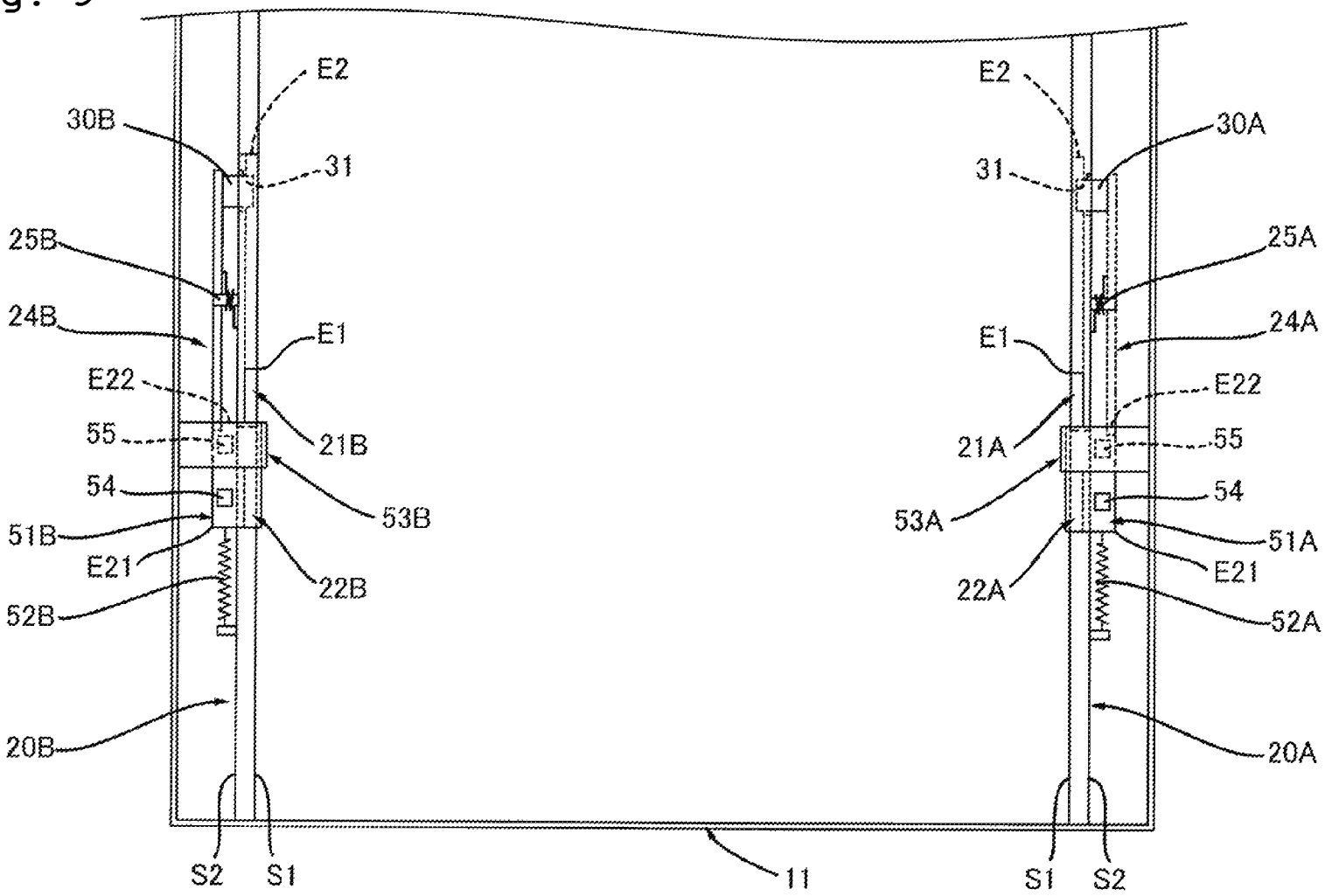
FIG. 9 is a plan view of the body depicted in FIG. 8.

In the third embodiment, as depicted in FIGS. 8 and 9, the image forming apparatus 1 includes a shutter 51A, a cover 53A, and a pulling member 52A.

Figure 10:
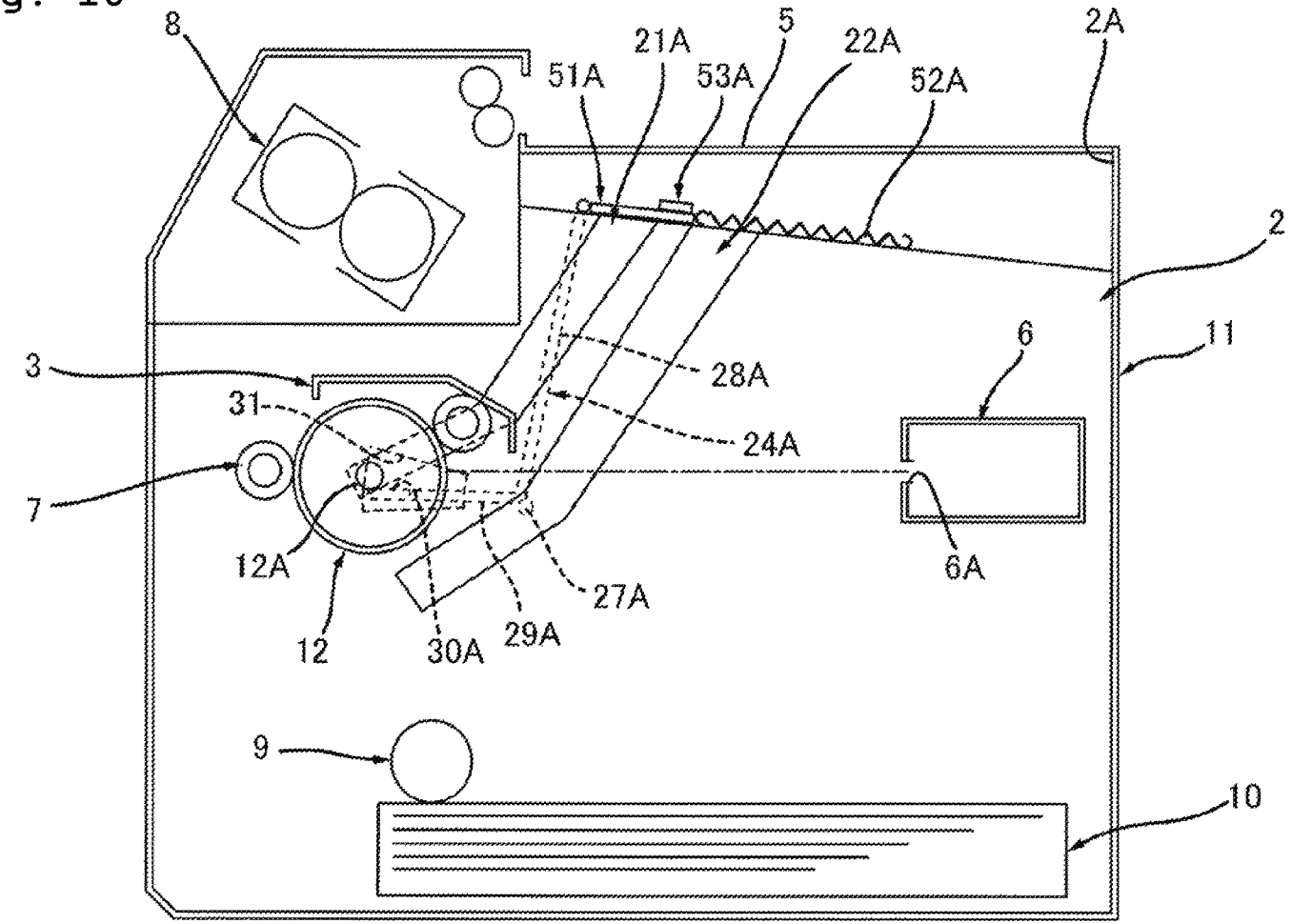
FIG. 10 is an explanatory diagram for explaining a movement of the shutter depicted in FIG. 8, showing a state where the drum cartridge is installed in the body.

The shutter 51A is configured to slide between a first position (see FIG. 8) and a second position (see FIG. 10). The shutter 51A moves linearly between the first position (see FIG. 8) and the second position (see FIG. 10). The shutter 51A extends in the slide direction of the shutter 51A. The shutter 51A extends in a direction intersecting the drum installation direction and the developing cartridge installation direction. The shutter 51A has a plate-like shape. The shutter MA has a display portion 54 and a display portion 55. Each of the display portion 54 and the display portion 55 displays guidance information. The display portion 55 may display different guidance information from the display portion 54. The guidance information may be previously printed onto the shutter 51A. The guidance information may be previously printed onto the display portion 54 and/or the display portion 55.

Figure 11:
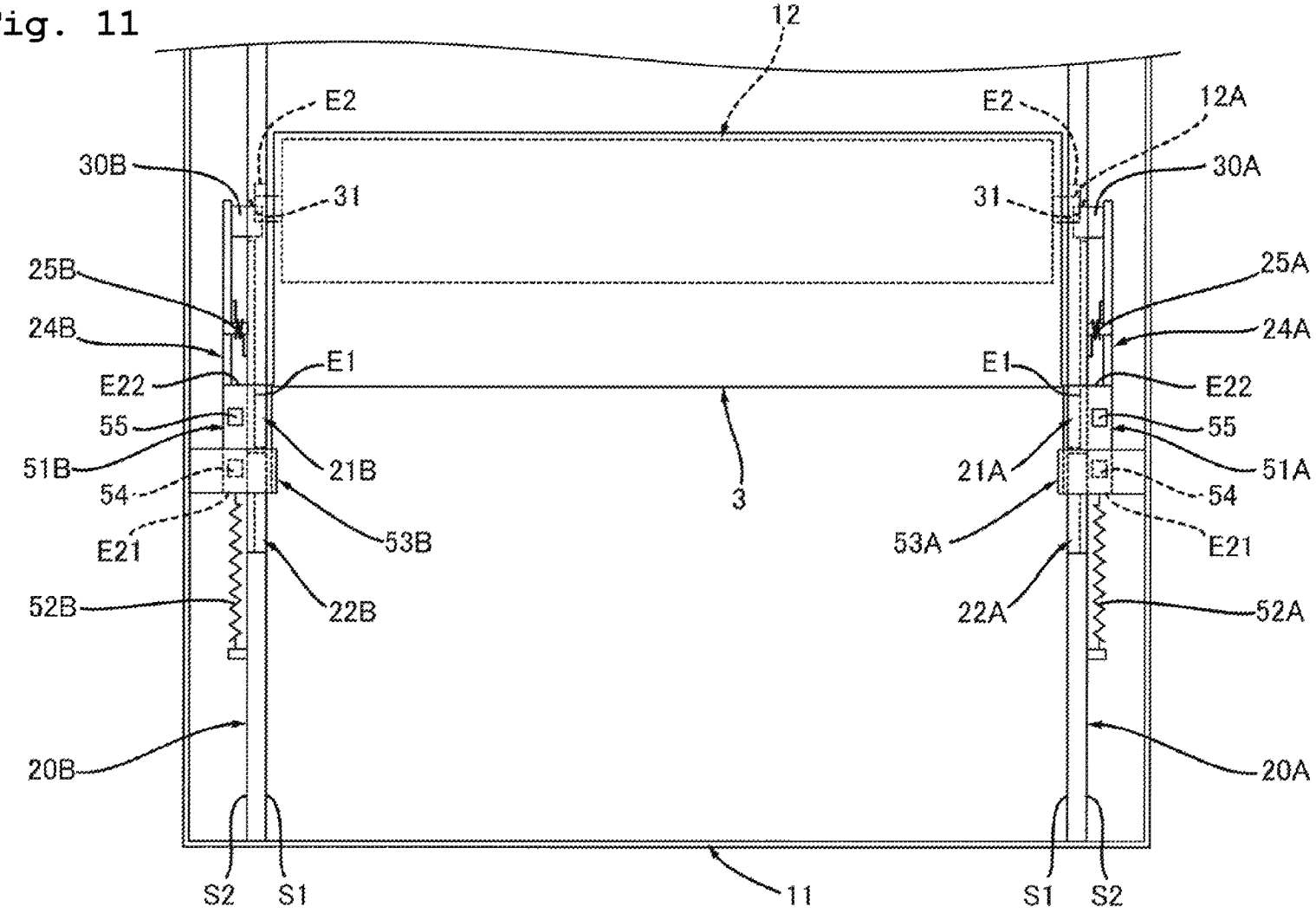
FIG. 11 is a plan view of the body depicted in FIG. 10.

As depicted in FIG. 9, the cover 53A covers the shutter 51A. The cover 53A covers part of the shutter 51A. The cover 53A is positioned between the drum guide 21A and the developing guide 22A. With the shutter 51A at the first position, the cover 53A covers the display portion 55. On this occasion, the display portion 54 is exposed from the cover 53A. Further, as depicted in FIG. 11, with the shutter 51A at the second position, the cover 53A covers the display portion 54. On this occasion, the display portion 55 is exposed from the cover 53A.

The pulling member 52A pulls the shutter 51A at the second position toward the first position. In particular, the pulling member 52A is an extension coil spring. In detail, the shutter 51A has an upstream end E21 and a downstream end E22 along the motion direction for the shutter 51A to move from the first position to the second position. One end of the pulling member 52A is attached to the upstream end E21 of the shutter 51A. The other end of the pulling member 52A is attached to the side frame 20A.

Further, in the third embodiment, as depicted in FIGS. 8 and 9, the image forming apparatus 1 includes a shutter 51B having the same shape as the shutter 51A, a cover 53B having the same shape as the cover 53A, and a pulling member 52B having the same shape as the pulling member 52A.

The shutter 51B is configured to slide between a third position (see FIG. 8) a fourth position (see FIG. 10).

The cover 53B covers the shutter 51B. The cover 53B covers part of the shutter 51B. The cover 53B is positioned between the drum guide 21B and the developing guide 22B. With the shutter 51B at the third position, the cover 53B covers the display portion 55 of the cover 53B. On this occasion, the display portion 54 of the cover 53B is exposed from the cover 53B. Further, as depicted in FIG. 11, with the shutter 51B at the fourth position, the cover 53B covers the display portion 54 of the cover 53B. On this occasion, the display portion 55 of the cover 53B is exposed from the cover 53B.

The pulling member 52B pulls the shutter 51B at the fourth position toward the third position.

According to the third embodiment, it is also possible to obtain the same functions and effects as the first embodiment.

The embodiments disclosed hereinabove are exemplary but not restrictive in each and every aspect. The image forming apparatus according to the present disclosure is not limited to the above embodiments but may be applied to by various changes and modifications without departing from the true scope and spirit of the present disclosure. For example, the image forming apparatus according to the present disclosure is not limited to the application to a printer but is also applicable to a facsimile apparatus, a photocopier, a multifunction peripheral, and the like. Further, it is possible to combine the technical features stated in the respective embodiments with each other.

What is claimed is:

1. An image forming apparatus comprising:

a body;

a drum cartridge installable into the body;

a developing cartridge installable into the body; and a shutter attached to the body, wherein the shutter is movable between a first position to prevent installation of the developing cartridge while allowing installation of the drum cartridge with the drum cartridge and the developing cartridge being removed from the body, and a second position to allow installation of the developing cartridge with the drum cartridge being installed in the body, wherein the body includes a drum guide configured to guide the drum cartridge in a case that the drum cartridge is installed into the body, a developing guide configured to guide the developing cartridge in a case that the developing cartridge is installed into the body, an inlet of the drum guide and an inlet of the developing guide being arranged side by side on the body, and wherein the shutter closes the inlet of the developing guide at the first position, without closing the inlet of the drum guide.

2. The image forming apparatus according to claim 1, wherein the shutter is configured to revolve between the first position and the second position.

3. The image forming apparatus according to claim 1, further comprising an arm, wherein the arm is connected to the body and the shutter, is revolvable with respect to the body, and has a first contact surface for contact with the drum cartridge when the drum cartridge is installed into the body.

4. The image forming apparatus according to claim 3, further comprising a pressing member provided to press the arm in a direction along which the shutter moves from the second position to the first position in a case that the shutter locates at the second position.

5. The image forming apparatus according to claim 3, wherein the body has a drum guide configured to guide the drum cartridge when the drum cartridge is installed into the body, and wherein a revolving shaft of the arm does not overlap with the drum guide.

6. The image forming apparatus according to claim 5, wherein the body has a developing guide configured to guide the developing cartridge in a case that the developing cartridge is installed into the body; and the revolving shaft is positioned between the drum guide and the developing guide.

7. The image forming apparatus according to claim 1, wherein the shutter has a display portion capable of displaying guidance information.

8. The image forming apparatus according to claim 1, wherein the body has a drum guide configured to guide the drum cartridge in a case that the drum cartridge is installed into the body, a developing guide configured to guide the developing cartridge when the developing cartridge is installed into the body, and a cover positioned between the drum guide and the developing guide and configured to cover the shutter.

9. The image forming apparatus according to claim 8, wherein the shutter has a first display portion which is capable of displaying guidance information, exposed from the cover when the shutter locates at the first position and covered by the cover when the shutter locates at the second position, and a second display portion which is capable of displaying different guidance information from the first display portion, exposed from the cover when the shutter locates at the second position and covered by the cover when the shutter locates at the first position.

10. An image forming apparatus comprising:

a body;

a drum cartridge installable into the body;

a developing cartridge installable into the body; and a shutter attached to the body, wherein the shutter is movable between a first position to prevent installation of the developing cartridge while allowing installation of the drum cartridge with the drum cartridge and the developing cartridge being removed from the body, and a second position to allow installation of the developing cartridge with the drum cartridge being installed in the body, and wherein the shutter is configured to slide between the first position and the second position.

11. An image forming apparatus comprising:

a body;

a drum cartridge installable into the body;

a developing cartridge installable into the body;

a shutter attached to the body; and an arm, wherein the arm is connected to the body and the shutter, is revolvable with respect to the body, and has a first contact surface for contact with the drum cartridge when the drum cartridge is installed into the body, wherein the shutter is movable between a first position to prevent installation of the developing cartridge while allowing installation of the drum cartridge with the drum cartridge and the developing cartridge being removed from the body, and a second position to allow installation of the developing cartridge with the drum cartridge being installed in the body, and wherein the arm has a second contact surface for contact with the drum cartridge when the drum cartridge is removed from the body.

12. The image forming apparatus according to claim 11, wherein the first contact surface and the second contact surface of the arm are flat surfaces.

13. The image forming apparatus according to claim 11, wherein an angle formed between the first contact surface and the second contact surface is not smaller than 90° and not larger than 170°.

14. An image forming apparatus comprising:

a body;

a drum cartridge installable into the body;

a developing cartridge installable into the body; and a shutter attached to the body, wherein the shutter is movable between a first position to prevent installation of the developing cartridge while allowing installation of the drum cartridge with the drum cartridge and the developing cartridge being removed from the body, and a second position to allow installation of the developing cartridge with the drum cartridge being installed in the body, wherein the body includes a drum guide configured to guide the drum cartridge in a case that the drum cartridge is installed into the body, a developing guide configured to guide the developing cartridge in a case that the developing cartridge is installed into the body, an inlet of the drum guide and an inlet of the developing guide being arranged side by side on the body, and wherein the shutter closes the inlet of the drum guide at the second position.

* * * * *